United States Patent [19]

Wingo, Jr.

[11] Patent Number: 5,029,341

[45] Date of Patent: Jul. 9, 1991

[54] FOOTBALL SHOULDER PAD

[75] Inventor: James C. Wingo, Jr., Houston, Tex.

[73] Assignee: Riddell, Inc., Chicago, Ill.

[21] Appl. No.: 397,073

[22] Filed: Aug. 22, 1989

[51] Int. Cl.[5] ..... A41D 13/00

[52] U.S. Cl. ..... 2/2; 2/44

[58] Field of Search ..... 2/2, 44, 45

[56] References Cited

U.S. PATENT DOCUMENTS

| | | | |
|---|---|---|---|
| 2,108,336 | 2/1938 | Helland | 2/2 |
| 2,163,463 | 6/1939 | Kennedy | 2/2 |
| 3,739,397 | 6/1973 | Truelove | 2/2 |
| 4,135,252 | 1/1979 | Latina et al. | 2/2 |
| 4,317,237 | 3/1982 | Porte | 2/2 |
| 4,425,667 | 1/1984 | Harrison | 2/2 |
| 4,453,271 | 6/1984 | Donzis | 2/2 |
| 4,467,475 | 8/1984 | Gregory et al. | 2/2 |
| 4,481,679 | 11/1984 | Hayes | 2/2 |
| 4,513,449 | 4/1985 | Donzis | 2/2 |
| 4,516,273 | 5/1985 | Gregory et al. | 2/2 |
| 4,590,621 | 5/1986 | Flosi et al. | 2/2 |

*Primary Examiner*—Werner H. Schroeder
*Assistant Examiner*—Michael A. Neas
*Attorney, Agent, or Firm*—Ben D. Tobor

[57] ABSTRACT

A shoulder pad for a football player, includes a rib protector pad body disposed adjacent to the body arch members and releasably connected to the pad body disposed beneath the body arch members of the shoulder pad.

9 Claims, 3 Drawing Sheets

FOOTBALL SHOULDER PAD

FIELD OF THE INVENTION

The invention relates to a shoulder pad for a football player, and includes a rib protector pad body disposed adjacent to the body arch members and releasably connected to a pad body disposed beneath the body arch members of the shoulder pad.

DISCUSSION OF THE PRIOR ART

In the sport of football, the football players wear protective gear generally comprised of structural members lined with padding, such as shoulder pads. Conventional shoulder pads are bilaterally symmetrical and are generally comprised of right and left body arch members which extend over the shoulders and include anterior and posterior portions, or depending chest and back portions, which overlie the chest and back of the athlete. The posterior portions, or depending back portions may be permanently hinged together on a vertical axis over the athlete's back or spine, while the anterior portion, or depending chest portions, are connected together on a vertical line over the athlete's sternum as by means of straps or lacing. Typically, conventional shoulder pads also utilize a pad body disposed beneath the body arch members, and the pad body is either fixedly secured, or releasably secured, to the body arch members. The structural members, such as the body arch members, as well as conventional shoulder cups and epaulets are manufactured from a suitable class of material having the requisite strength characteristics to withstand the forces of impact incurred in the playing of the game of football.

In many instances the football players will also wear a rib protector, or rib pads, which is a separate pad structure disposed about the football player and typically suspended by a pair of straps from the player's shoulders. Because of the manner in which the rib protector is suspended, it can quickly and easily slide about the player's body, whereby the padding becomes dislocated from its intended location. This sliding movement about the player's body is frequently distracting and bothersome to the football player, whereby many players will not wear this additional form of protection against the forces of impact incurred in the playing of the game, until such time as the player has already experienced an injury to his ribs. An additional disadvantage with prior art rib protectors is that they typically only provide for protection of the player's ribs and not that portion of his back which is adjacent the ribs, and located in between the two pads which typically form the rib protector. Thus, many players, even when wearing conventional rib protector pads, have the lower portion of their back exposed to potential blows and impact forces incurred during a game.

Accordingly, prior to the development of the present invention, there has been no football shoulder pad which: includes a flexible rib protector pad which does not slide about the football player's body, whereby the rib protector pads remain disposed at the proper location to protect the football player; and additionally provides for protection of the lower portion of the football player's back. Therefore, the art has sought a football shoulder pad which includes a flexible rib protector pad which attempts to insure that the rib protector pad remains in the desired location about the football player, and further provides protection to the lower portion of the back of the football player.

It should be noted that due to the nature of the sport of football, as well as other contact sports, no protective equipment, such as shoulder pads, can prevent injuries; however, it is believed that such equipment can be designed to attempt to better protect the player from injuries.

SUMMARY OF THE INVENTION

In accordance with the invention, the foregoing advantages have been achieved through the present shoulder pad for a football player. The present invention of a shoulder pad for a football player includes: body arch members having depending chest and back portions; a pad body, having a back, lower edge surface disposed beneath the body arch members, which pad body overlies a substantial portion of the chest and back of the football player; a flexible rib protector pad body for substantially encircling the body of the football player to protect the ribs of the football player from impact forces, the rib protector body having a back, upper edge surface; and the pad body is connected to the rib protector pad body, and the back, lower edge surface of the pad body is disposed adjacent to the back, upper edge surface of the rib protector pad body, whereby a substantial portion of the chest, substantially all of the back and the ribs of the football player are protected from impact forces.

Another feature of the present invention is that the shoulder pad may include a means for releasably connecting the pad body to the rib protector pad body. A further feature of the present invention is that the releasable connection means may be a zipper; a portion of the zipper being disposed on the pad body, and another portion of the zipper being disposed on the rib protector pad body.

An additional feature of the present invention is that the rib protector pad body may have a plurality of protective plate members disposed thereon. Another feature of the present invention is that at least two of the protective plate members may have side edge surfaces which taper downwardly toward the lower portion of the back of the football player, whereby the rib protector pad body, with the protective plate members disposed thereon, better fits and contours the football player. A further feature of the present invention is that a back plate member may be disposed on the pad body above the back, rear edge surface, and below the depending back portion of the body arch members.

Another feature of the present invention is that the rib protector pad body may include at least one layer of open, or closed, cell foam material, and the flexibility of the foam material permits the football player to effectively grasp a football between the rib protector pad body and the forearm of the football player. A further feature of the present invention is that the shoulder pad may include a front abdomen pad for protecting the abdomen of the football player, and the front abdomen pad may be releasably connected to the pad body.

The shoulder pad for a football player of the present invention, which includes a flexible rib protector pad body connected to the pad body, when compared with previously proposed prior art rib protector pads and shoulder pads, has the advantages of: preventing undesired and bothersome movement of the rib protector pad about the football player: and provides additional protection to the lower back and abdomen of the football player.

While the invention will be described in connection with the preferred embodiment, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF THE INVENTION

Figure 2:
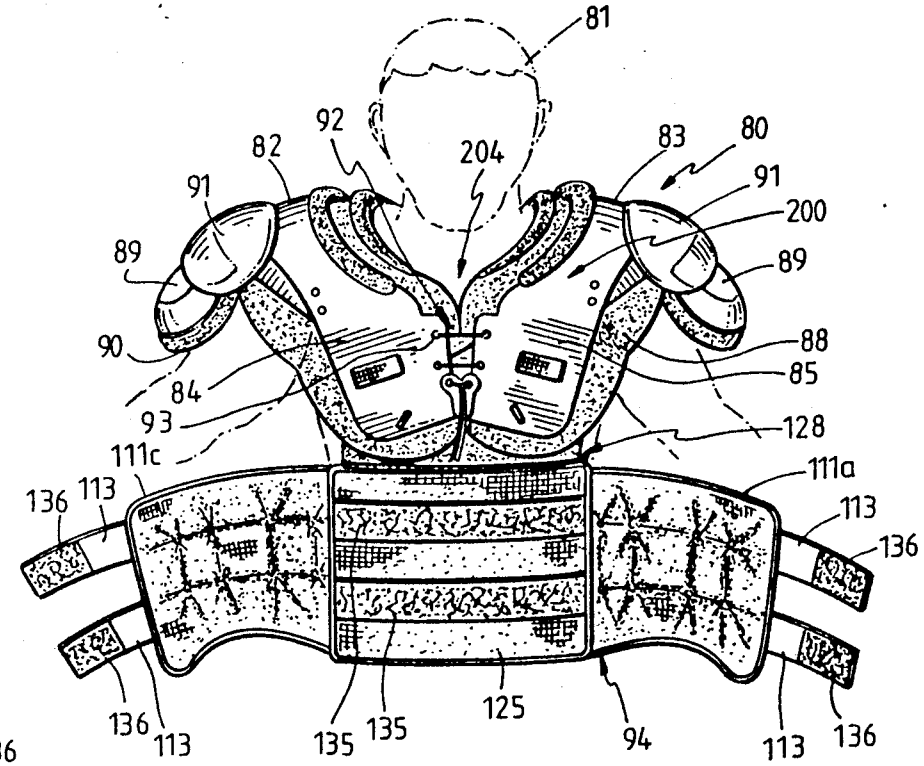
FIG. 2 is a front view of a football player wearing a shoulder pad in accordance with the present invention.
Figure 1:
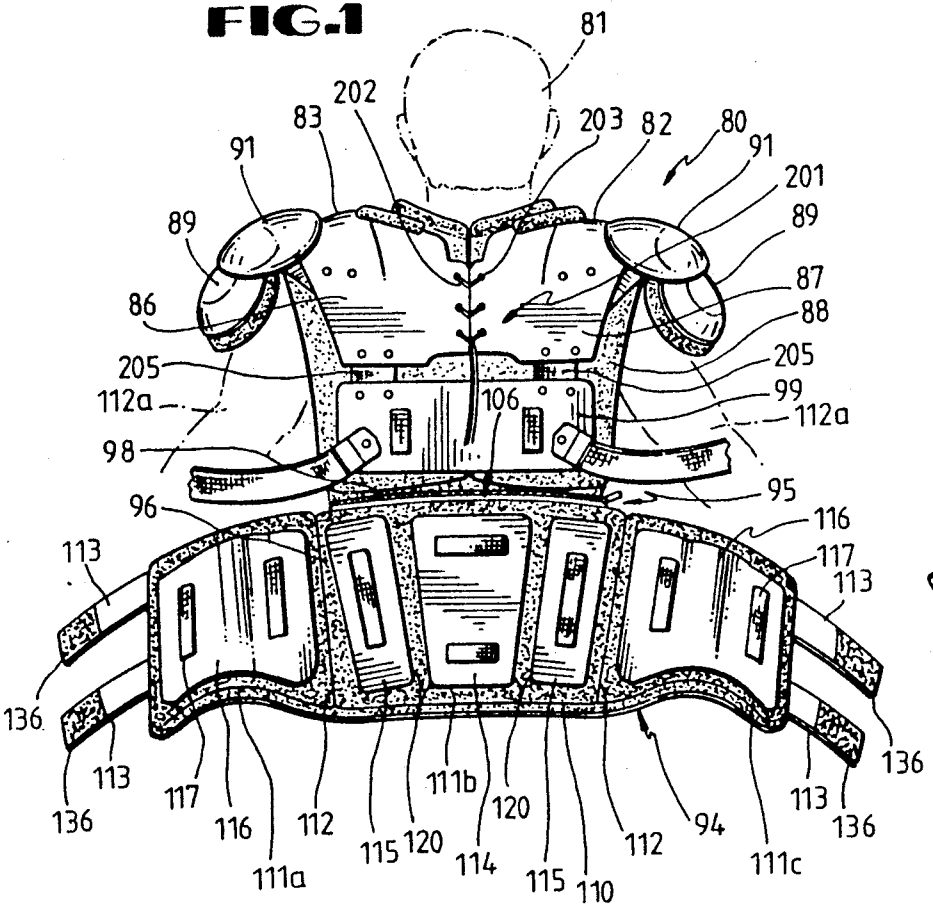
FIG. 1 is a back view of a football player wearing a shoulder pad in accordance with the present invention.

In FIGS. 1 and 2, a shoulder pad 80 for a football player 81 (not shown in dotted lines) is shown to generally comprise left and right body arch members 82, 83, each body arch member including depending chest portions 84,85 and depending back portions 86, 87, the shoulder pad 80 being bilaterally symmetrical. Shoulder pad 80 also includes a pad body 88 disposed beneath the body arch members 82,83, which pad body is either fixedly secured or releasably secured, to the body arch members 82,83 and overlies a substantial portion of the chest 200 and back 201 of the football player 81. The shoulder pad 80 may also be provided with conventional shoulder cups 89 which overlie the deltoid muscles 90 of the football player 81, as well as conventional epaulets 91 are attached to the body arch members 82,83. As is well known in the art, depending back portions 86,87 of body arch members 82,83 may be permanently hinged together on a vertical axis over the football player's 81 back 201, or spine, or laced together with laces 202 through openings 203, while the depending chest portions 84,85 are connected together on a vertical line over the football player's sternum 204 of chest 200 as by a lacing 92 passing through lace openings 93 provided on the depending chest portions 84,85 of body arch members 82,83. Body arch members 82,83, as well as shoulder cups 89 and epaulets 91 are made of any suitable material, such as a suitable plastic, having the requisite strength and rigidity requirements to withstand the forces of impact incurred in the sport of football, as is well known in the art. In this regard, it should be noted that although the present invention is being described in connection with a football shoulder pad 80, the present invention could likewise be used in protective pads of similar construction which are worn by athletes for other contact sports, such as hockey.

Figure 4:
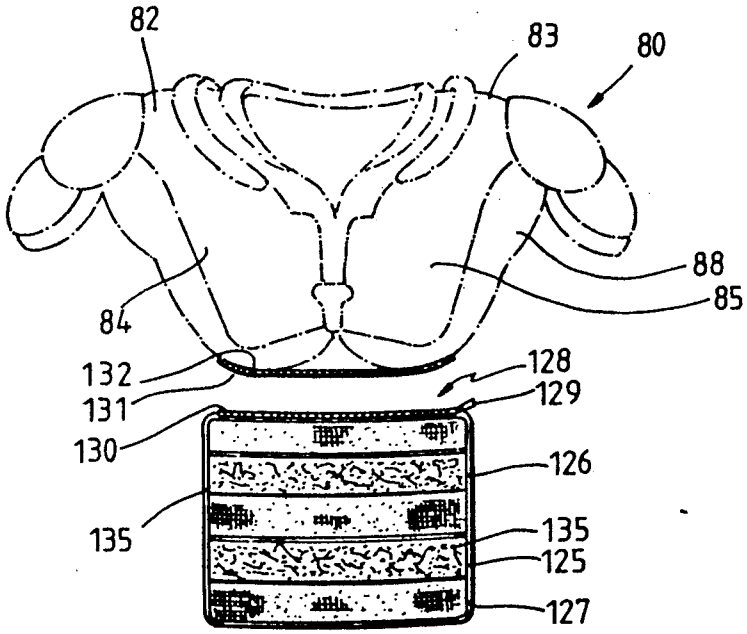
FIG. 4 is a front view illustrating a detached front abdomen pad in accordance with the present invention.
Figure 3:
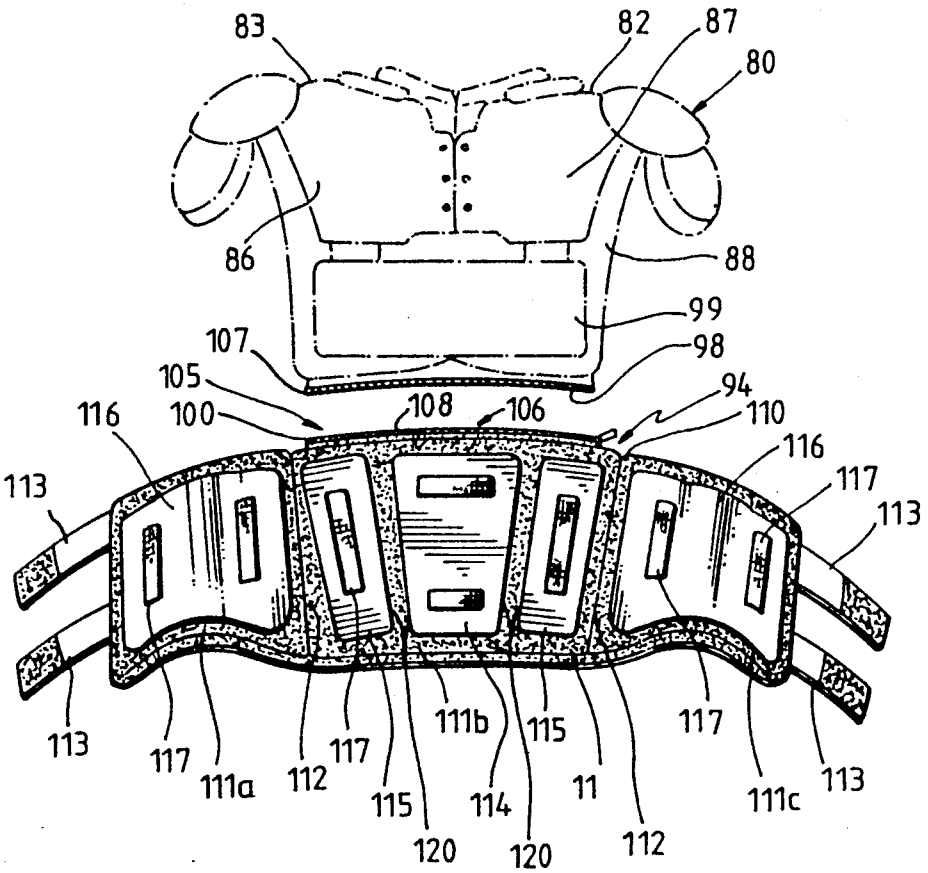
FIG. 3 is a back view of a rib protector pad detached from the pad body of a shoulder pad in accordance with the present invention.
Figure 5:
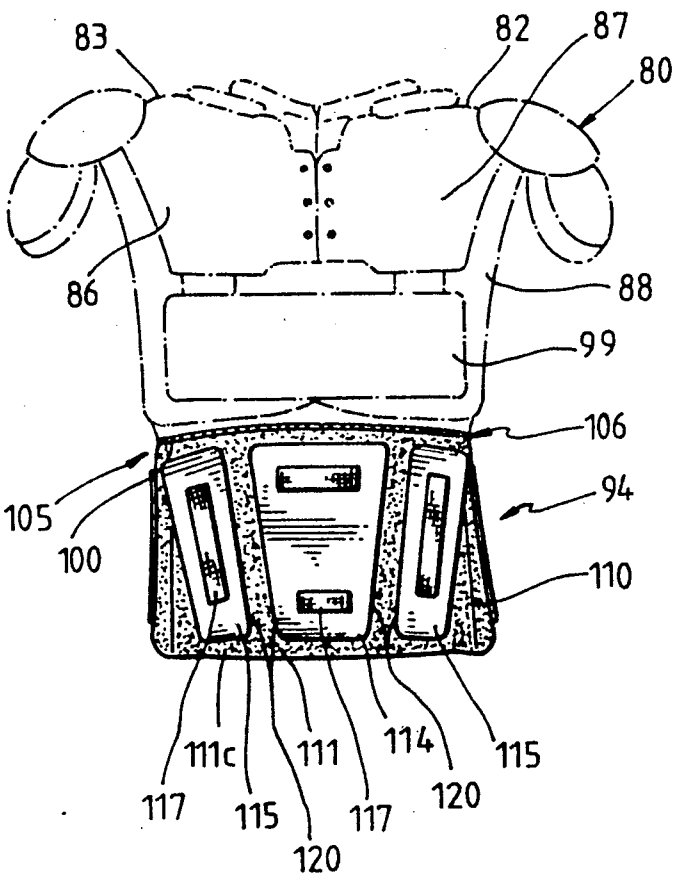
FIG. 5 is a back view of a rib protector pad attached to a pad body of a shoulder pad in accordance with the present invention.

With reference to FIGS. 1–6, shoulder pad 80 is shown to include a flexible rib protector pad body 94, which is intended to substantially encircle the body 95 of football player 81 to protect his ribs 96, as well as his Latissimus Dorsi muscles, from impact forces incurred during the playing of the game of football. In this regard, a portion of the ribs 96 of the football player 81 will be protected by the depending chest portions 84, 85 of body arch members 82, 83, including pad body 88, as well as by depending back portions 86. 87 of body arch members 82, 83, whereby rib protector pad body 94, serves to protect that portion of the ribs 96 and the Latissimus Dorsi muscles of the football player not protected by the elements of shoulder pad 80, previously described. It should be noted that the depending back portions 86, 87 of body arch members 82, 83 may extend downwardly until they are adjacent a back, lower edge surface 98 (FIGS. 1, 3, and 5) of pad body 88, or alternatively, a back plate member 99 may be disposed upon the pad body 88 above the back, rear edge surface 98 and below the depending back portions 86, 87 of body arch members 82, 83, as seen in FIGS. 1, 3, and 5. Back plate member 99 may also be made of any suitable material, such as a suitable plastic, having the requisite strength and rigidity requirements to withstand the forces of impact incurred in the sport of football, as is well known in the art. Back plate member 99 may be suspended from depending back portions 86, 87 of body arch member 82, 83, as by straps 205.

With reference to FIGS. 1, 3 and 5, flexible rib protector pad body 94 has a back, upper edge surface 100. Pad body 88 is connected to the rib protector pad body 94 and the back, lower edge surface 98 of the pad body 88 is disposed adjacent to the back, upper edge surface 100 of the rib protector pad body 94. Accordingly, a substantial portion of the chest 200 and Latissimus Dorsi muscles, substantially all of the back 201, and the ribs 96 of the football player are protected from impact forces. Although flexible rib protector pad body 94 may be connected to the pad body 88, so as to be integral therewith, the flexible rib protector pad body 94 may be releasably connected to the pad body 88, as will hereinafter be described in greater detail.

For many football players, it is not necessary to wear rib protector pads during practice sessions, since many practice sessions will be "non-contact" or "walk-through" practice sessions, wherein the teammates of the football player will not be making contact with the football player, or if contact is made, it will be relatively light. Thus, it may only be necessary to have the additional protection, such as is afforded by shoulder pad 80, only during football games, during which time the normal impact forces are incurred by the football player 81. Thus, it may be preferable to provide for some football players 81, a flexible rib protector pad body 94, which can be disconnected from the pad body 88 during the week, and then connected to the pad body 88 for wearing during a game. It should be noted that for some football players, such as elementary school and junior high football players, it may be desirable to always provide the additional protection afforded by flexible rib protector pad body 94, whereby it may not be preferred to have flexible rib protector pad body detachable from pad body 88.

The means for releasably connecting 105 the pad body 88 to the rib protector pad body 94 may be any suitable releasable connection means, which can serve to maintain a disposition of the rib protector pad body 94 adjacent to the pad body 88, while the shoulder pad 80 is being worn by the football player 81, and the football player 81 is sustaining impact forces from the contact of other football players upon the shoulder pad 80 of football player 81. Releasable connection means 105 could be a plurality of straps, buckles, hook and eye material, such as VELCRO ®, or lacings; however, it is preferred that releasable connection means 105 comprises a zipper 106, a portion 107 of the zipper 106 being disposed upon the pad body 88 and another portion 108 of the zipper being disposed on the rib protector pad body 94. As seen in FIG. 3, zipper portion 107 is disposed adjacent the back, lower edge surface 98 of the pad body 88, and the zipper portion 108 is disposed upon the back, upper edge surface 100 of rib protector pad body 94.

Still with reference to FIGS. 1, 3 and 5, the flexible rib protector pad body 94 will be described in greater detail. Rib protector pad body 94 may be made of any suitable athletic shock absorbing pad material, such as at least one layer of open, or closed, cell foam material 110, which foam material 110 is preferably disposed within a flexible enclosure 111. Flexible enclosure 111 is made of any material which has the requisite strength and durability characteristics to withstand the forces of impact sustained during the playing of the game of football. Preferably, flexible enclosure 111 is made of Nylon. Preferably, flexible enclosure 111 is formed as three flexible enclosures 111*a*, 111*b*, and 111*c*, flexible enclosures 111*a* and 111*c* providing protection to the ribs 96 of the football player, and flexible enclosure 111*b* providing protection for the lower back 201 of the football player 81. At least one layer of open, or closed, cell foam material 110 is disposed within each flexible enclosure 111*a–c*. The same foam material 110 may be used for rib protector pad body 94, as is used for pad body 88, or alternatively, different shock absorbing pad materials may be used. One example of a suitable shock absorbing pad material 110 and flexible enclosure 111 would be the shock absorbing pad structure described in Applicant's co-pending patent application, application Ser No. 373,501, filed June 30, 1989, now U.S. Pat. No. 4,926,503 which discloses a flexible, open-cell foam member comprised of two layers of open-cell foam, the density of the layers of the open-cell foam being different from one another. It should be readily apparent to one of ordinary skill in the art, that other shock absorbing pad structures and materials can be utilized for pad body 88 and rib protector pad body 94, so long as such shock absorbing pad structure has the requisite strength and durability requirements necessary to withstand the impact forces incurred, as well as being capable of providing a level of protection to the football player 81.

With regard to a football player 81 who is a running back, or ball carrier, it is also necessary that the foam material 110 used for rib protector pad body 94 has the requisite flexibility to permit the football player 81 to effectively grasp the football between the rib protector pad body 94 and a forearm 112 (FIG. 1) of football player 81. In this regard, as will be hereinafter described in further detail, many running backs feel uncomfortable wearing a rib protector because when they are holding, or grasping, the ball against their body as with their forearm 112, with many prior art rib protectors, the football player 81 cannot "feel" the ball (not shown) or its location against their ribs 96, whereby the likelihood of a fumble of the ball may be increased. Accordingly, the flexibility of the foam material 110, in particular that used within flexible enclosures 111*a* and 111*c*, must be such that it permits the football player to effectively grasp the football between the rib protector pad body 94 and his forearm 112. If the flexibility and compressibility of the foam material 110 used in rib protector pad body 94 is overly flexible and compressible, the foam material 110 cannot provide sufficient protection to the football player 81; whereas if the foam material 110 is too rigid and not very compressible, there is a tendency for a football to bounce off of the rib protector pad body 94 when a football is grasped against rib protector pad body 94, particularly against flexible enclosures 111*a* or 111*c*.

Still with reference to FIGS. 1, 3, and 5, it should be noted that flexible enclosure 111 may be formed of one layer of material which is sewn together so as to provide the separate flexible enclosures 111*a*–111*c*, or the three flexible enclosures 111*a*–111*c* can be formed separately and joined, as by sewing, along edge surfaces 112. As will be hereinafter described in further detail, a plurality of straps 113 may be provided to secure rib protector pad body about the body 95 of the football player 81.

If desired, rib protector pad body 94 may have a plurality of protective plate members 114–116 disposed thereon. The protector plate members 114–116 may likewise be made of any suitable material, such as the plastic material used for arch members 86, 87 as previously described. Protector plate members 114–116 may be secured to the outer surface of rib protector pad body 94, in any suitable fashion, such as by straps 117, which may be secured to the outer surface of flexible enclosures 111*a*–111*c*, and which pass through openings formed in the protector plate members 114–116. If desired, all rib protector pad bodies 94 may have protective plate members 114, 115, disposed on the back flexible enclosure 111*b*, to provide additional protection to the back 201 of the football player 81. If the football player 81 wearing rib protector pad 94 is a running back, or other player who frequently carries the football, side protective plate members 116 may be deleted, whereby the football player 81 can effectively grasp the football against the rib protector pad body 94, as previously described. If football player 81 is not a ball carrier, then protective plate members 116 may be provided on the side portions, or flexible enclosures 111*a* and 111*c* of rib protector pad body 94, so as to provide additional protection to the ribs 96 of football player 81. It should be noted that in lieu of three protective plate members, or back protective plate member 114 and the two back, side protective plate members 115, a single protective plate member could be utilized. Preferably, a back protective plate member 114, and the two side, back protective plate members 115 are utilized, and these protective plate members have side edge surfaces 120 which taper downwardly toward the lower portion of the back 201 of the football player 81, whereby the rib protector pad body 94 with protective plate members 114, 115 disposed thereon, better fits and contours the football player 81.

With reference now to FIGS. 2. 4, and 6, shoulder pad 80 may include a front abdomen pad 125 for providing additional protection to the abdomen of a football player 81. As with rib protector pad body 94, abdomen pad 125 may include at least one layer of open, or closed, cell foam material 126 disposed within a flexible enclosure 127, foam material 126 being the same as that previously described as being used for rib protector pad body 94. As with rib protector pad body 94, abdomen pad 125 may be formed integral with pad body 88, or preferably shoulder pad 80 includes a means for releasably connecting 128 front abdomen pad 125 to the pad body 88. Releasable connection means 128 may be any suitable releasable connection means, such as snaps, straps, hook and eye material such as VELCRO®, or may preferably be a zipper 129, having one portion 130 of the zipper being disposed upon the abdomen pad 125, and another portion 131 of the zipper 129 being disposed on the front lower edge surface 132 of the pad body 88.

Figure 6:
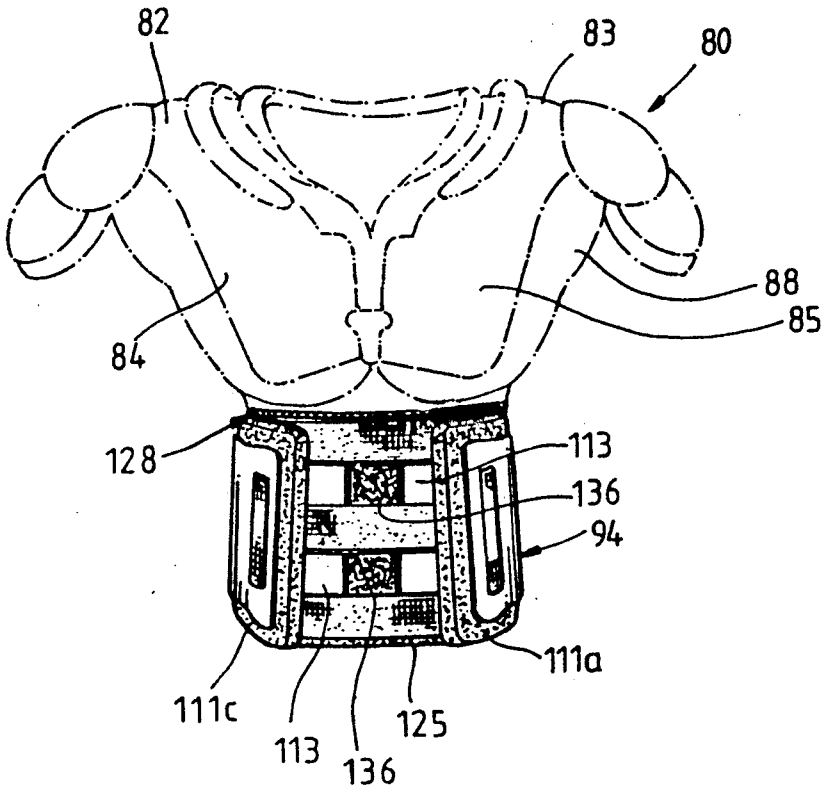
FIG. 6 is a front view of a rib protector pad body and a front abdomen pad connected to a pad body of a shoulder pad in accordance with the present invention.

With reference to FIGS. 2, 4, and 6, front abdomen pad 125 may be provided with one or more strips 135 of an adhesive material such as a hook and eye material, such as VELCRO®, disposed on the front surface of abdomen pad 125. The straps 113 of rib protector pad body 94 may likewise be provided with a suitable adhesive material, such as strips of VELCRO® 136, whereby when football player 81 is utilizing abdomen pad 125, straps 113 are wrapped around the body as of player 81, and the VELCRO® material 136 cooperates with the adhesive material, or VELCRO® material, 135 disposed upon front abdomen pad 125, whereby rib protector pad body 94 is secured about the body as of player 81, as well as is secured to abdomen pad 125. When front abdomen pad 125 is not utilized, the adhesive material, or VELCRO® material, 136 disposed on belts 113 cooperates with each other to also secure rib protector pad body 94 about the body as of player 81.

It is to be understood that the invention is not limited to the exact details of construction, operation, exact materials or embodiments shown and described as obvious modifications and equivalents will be apparent to one skilled in the art. For example, the rib protector pad body could be releasably secured to the front of the pad body, whereby the straps could be connected at the back of the football player. Accordingly, the invention is therefore to be limited only by the scope of the appended claims.

I claim:

1. A shoulder pad for a football player, comprising:

body arch members having depending chest and back portions;

a pad body, having a back, lower edge surface, disposed beneath the body arch members, wherein the pad body overlies a substantial portion of the chest and back of the football player;

a flexible rib protector pad body for substantially encircling the body of the football player to protect the ribs of the football player from impact forces, the rib protector body having a back, upper edge surface;

a means for releasably connecting the pad body to the rib protector pad body; and the pad body is releasably connected to the rib protector pad body, and the back, lower edge surface of the pad body is disposed adjacent to the back, upper edge surface of the rib protector pad body, whereby a substantial portion of the chest, substantially all of the back, and the ribs of the football player are protected from impact forces.

2. The shoulder pad of claim 1, wherein the releasable connector means comprises a zipper; a portion of the zipper being disposed on the pad body, and another portion of the zipper being disposed on the rib protector pad body.

3. The shoulder pad of claim 1, wherein the rib protector pad body has a plurality of protective plate members disposed thereon.

4. The shoulder pad of claim 3, wherein a back plate member is disposed on the pad body above the back, rear edge surface and below the depending back portions of the body arch members.

5. The shoulder pad of claim 3 wherein at least two of the protective plate members have side edge surfaces tapering downwardly toward the lower portion of the back of the football player, whereby the rib protector pad body, with the protective plate members disposed thereon, better fits and contours the football player.

6. The shoulder pad of claim 1, wherein the rib protector pad body comprises at least one layer of open, or closed, cell foam material, and the flexibility of the foam material permits the football player to effectively grasp a football between the rib protector pad body and a forearm of the football player.

7. The shoulder pad of claim 1, further including a front abdomen pad for protecting the abdomen of the football player, disposed below the depending chest portion of the body arch member.

8. The shoulder pad of claim 7, including a means for releasably connecting the front abdomen pad to the pad body.

9. The shoulder pad of claim 8, wherein the releasable connection means comprises a zipper; a portion of the zipper being disposed on the pad body, and another portion of the zipper is disposed on the front abdomen pad.

* * * * *